US005323931A

United States Patent [19]

Robards, Jr. et al.

[11] Patent Number: 5,323,931

[45] Date of Patent: Jun. 28, 1994

[54] DISPENSER FOR EXTRUDABLE MATERIAL INCLUDING DISPENSING FROM COLLAPSIBLE CONTAINERS

[75] Inventors: Chester F. Robards, Jr., Roselle; Daniel A. Rubino, Carol Stream, both of Ill.

[73] Assignee: Prince Castle Inc., Carol Stream, Ill.

[21] Appl. No.: 14,630

[22] Filed: Feb. 8, 1993

[51] Int. Cl.[5] ..... B67D 5/00

[52] U.S. Cl. ..... 222/96; 222/105; 222/309; 222/326; 222/387; 222/391; 222/472; 222/474; 222/511

[58] Field of Search ..... 222/96, 105, 287, 326, 222/387, 391, 511, 94, 95, 309, 325, 327, 469, 472, 473, 474,

[56] References Cited

U.S. PATENT DOCUMENTS

| | | | |
|---|---|---|---|
| 1,847,188 | 3/1932 | Kreidel | 222/391 X |
| 1,851,794 | 3/1932 | Wilson | 222/391 X |
| 2,113,022 | 4/1938 | Hefti | 222/214 X |
| 2,533,282 | 12/1950 | Osman | 222/387 |
| 2,570,755 | 10/1951 | Booth | 222/96 |
| 2,604,858 | 7/1952 | Bosa | 222/391 X |
| 3,132,772 | 5/1964 | Bristow | 222/387 X |
| 3,161,325 | 12/1964 | Hinkel et al. | 222/391 |
| 3,231,149 | 1/1966 | Yuza | 222/309 X |
| 3,443,725 | 5/1969 | Lawhorn | 222/79 |
| 4,142,654 | 3/1979 | Doubleday et al. | 222/309 |
| 4,258,865 | 3/1981 | Vahl et al. | 222/213 |
| 4,299,336 | 11/1981 | Studer | 222/80 |
| 4,318,499 | 3/1982 | Hamilton | 222/327 |
| 4,330,070 | 5/1982 | Doubleday | 222/287 X |
| 4,645,098 | 2/1987 | Hoffmann | 222/386 |
| 4,685,595 | 8/1987 | Segatz | 222/326 |
| 4,711,373 | 12/1987 | Christine | 222/105 X |
| 4,840,293 | 6/1989 | Segatz | 222/326 X |
| 4,961,508 | 10/1990 | Weimer et al. | 222/181 |
| 5,150,820 | 9/1992 | McGill | 222/95 |
| 5,156,305 | 10/1992 | Eyre | 222/327 |

FOREIGN PATENT DOCUMENTS

| | | | |
|---|---|---|---|
| 773502 | 11/1934 | France . | |
| 1094277 | 5/1955 | France | 222/96 |
| 1127069 | 12/1956 | France | 222/391 |
| 34941 | 9/1905 | Switzerland | 222/387 |
| 228389 | 11/1943 | Switzerland | 222/96 |
| 229913 | 2/1944 | Switzerland | 222/325 |
| 669165 | 2/1989 | Switzerland | 222/95 |
| 264673 | 6/1970 | U.S.S.R. . | |
| 2088998 | 6/1982 | United Kingdom | 222/95 |
| 2090336 | 7/1982 | United Kingdom | 222/95 |
| 2171462A | 8/1986 | United Kingdom . | |
| 2186544A | 8/1987 | United Kingdom . | |
| 9208670 | 5/1992 | World Int. Prop. O. | 222/105 |

*Primary Examiner*—Andres Kashnikow
*Assistant Examiner*—Anthoula Pomrening
*Attorney, Agent, or Firm*—Wood, Phillips, VanSanten, Hoffman & Ertel

[57] ABSTRACT

A dispenser is provided for dispensing the extrudable contents of a collapsible container having a nozzle through which the container can be discharged by collapsing the container. The dispenser is of a piston/cylinder device, with the piston having a container-engaging face provided with a contoured structure of a predetermined configuration corresponding generally to a collapsing profile of the collapsible container. An elongated flexible valve device is slidably mounted relative to the housing and includes a coupling end coupled directly to a trigger member of the dispenser and a valve end for opening and closing an opening in the housing which defines the cylinder of the device. The flexible valve device is a band member of plastic material and is operatively associated with a mechanism for holding the valve open when a cover of the housing is removed and for automatically closing the valve when the cover is replaced. A pistol grip handle and the trigger of the dispenser are ergodynamically configured for ease of operation. A set of interchangeable stop cams are provided for positioning between the trigger and the pistol grip handle for selectively determining a metered amount of material to be dispensed by the dispenser for each actuation of the trigger.

39 Claims, 7 Drawing Sheets 34
82
112
80
78a
92
90
76
77
72
H
48
88
96
94
98a
98
100
74
42
134
110
108
106
104
102
132
128
G
78
86
84
72a
130
F
36
70
153b
153
153a
140
46
66
68
140
N
142
66b
132
130
153B
153

196
T
136
138
136a
78a
34
88
198
98
134
G
78
204
L
200
202
132
130
128
K
194
38
M
150
148
46
152
132a
154
36
N
140
142
44
60
132
130
148
J 188
182
184
192
190
180
186
132
Q
R

DISPENSER FOR EXTRUDABLE MATERIAL INCLUDING DISPENSING FROM COLLAPSIBLE CONTAINERS

FIELD OF THE INVENTION

This invention generally relates to the art of dispensers and, particularly, to a dispenser for dispensing extrudable material and, further, to a dispenser including features for facilitating dispensing the extrudable contents of a collapsible container.

BACKGROUND OF THE INVENTION

Dispensers for dispensing a viscous or extrudable material have been proposed in a wide variety of designs, ranging from a common piston-type caulking gun found in any hardware store to small hand-held twisting devices for rolling up a tube of extrudable toothpaste. Dispensers for extrudable material even have been proposed for hydraulic actuation. Commonly, the extrudable material is dispensed from a cylindrical housing by an advancable piston. Other dispensers are designed for collapsible containers and employ roller mechanisms which take the place of the more common advancable piston. When used as hand implements, most such dispensers have one form or another of a pistol grip handle mechanism, along with a ratcheting or ratchetless device operatively associated with the handle for incrementally advancing the piston within the cylinder of the dispenser. The ratcheting device may be operated through a trigger member mounted adjacent the piston grip handle. Roller mechanisms, for instance, are more applicable for use with rather "stiff" collapsible containers and are not very effective for use with relatively "limp" containers because of jamming problems with the roller carriage, and the rollers are not effective when the extrudable material includes lumpy particles.

Although dispensers of the character described for extruding viscous contents from collapsible containers have been proposed for many years, there still is a definite need for a much more effective dispenser than has heretofore been available. This has become particularly prevalent in dispensing fluid condiments, such as ketchup, mustard, tartar sauce and the like, from collapsible containers in high volume restaurants or other establishments. These collapsible containers commonly are called "pouches" and the viscous material is contained in a relatively thin or limp plastic container versus the more stiff containers for products such as grease, toothpaste and the like. In addition, whereas the prior art is directed to dispensing extrudable material from tubularly shaped collapsible containers, such pouches are generally rectangularly shaped and generally flat in configuration, with heat sealed hems about the periphery thereof. It would be very difficult to manipulate and hold such pouches between the rollers of a roller-type dispenser. In addition, heretofore, it has been assumed that it would be very difficult, if not impossible, to use piston-type dispenser guns of the prior art for such applications. Still further, in high volume food establishments, it is desirable to ensure that a high percentage of the contents of the pouches are extruded when empty in order to avoid costly waste. And still further, in high volume food establishments, quality control is considered critical, whereby precise metered amounts of the condiments are required for dispensing onto a given food product according to very specific "recipe" parameters.

This invention is directed to satisfying the needs, to solving the problems and to overcoming the limitations of prior dispensing devices or systems as outlined above. The invention particularly is directed to a number of unique features in a dispenser of the character described.

SUMMARY OF THE INVENTION

An object, therefore, of the invention is to provide a new and improved dispenser for dispensing extrudable material, and particularly the extrudable contents of a collapsible container, such as a container having a nozzle through which the contents can be discharged by collapsing the container.

According to one aspect of the invention, a dispenser of the character described includes a housing means for holding the collapsible container, including a pistol grip handle at one end of the housing means and an opening at an opposite end of the housing means at which the nozzle is registrable. An extruding member is movably mounted in the housing means for engaging the container remote from the nozzle. Advancing means are operatively associated with the extruding member for relatively moving the extruding member and the housing means for advancing the extruding member toward the opening for extruding the contents of the collapsible container. A trigger member is movably mounted adjacent the pistol grip handle to incrementally advance the extruding member for each actuation of the trigger to effect a metered dispensing of the contents of the container. An elongated flexible valve device is slidably mounted relative to the housing means and includes a coupling end coupled substantially directly to the trigger member and a valve end for opening and closing the opening in response to movement of the trigger member.

In an exemplary embodiment of the invention, the elongated flexible. valve device is provided in the form of a thin band-like member of plastic material with the coupling end and the valve end thereof being substantially integral therewith. The coupling end is an enlarged portion of the band-like member received in an enlarged socket in the trigger to provide lost motion between the trigger and the valve device. The valve end is in the form of an enlarged portion of the band-like member engageable against a valve seat of the housing means to sandwich the nozzle of the collapsible container therebetween. The band-like member of plastic material has a given width and a given thickness, with a bent portion thereof conforming to a curved portion of the housing means, with the bent portion of the band-like member being thinner than the given thickness thereof.

According to another aspect of the invention, the dispenser is adapted for dispensing the extrudable contents of a collapsible container which is fabricated of flexible film-like material, whereby the container is collapsible in an accordion-like fashion. The housing means of the dispenser is provided generally in the form of a cylinder within which a unique extruding member or piston is movable. The piston has a container-engaging face having a contoured structure of a predetermined configuration corresponding generally to a collapsing profile of the collapsible container.

In the exemplary embodiment of the invention, the contoured structure of the container-engaging face of the piston includes a central portion projecting toward the opening of the housing, with recess means outside the projecting portion for accommodating accordion-like pleats formed about the collapsible container during collapsing thereof. The contoured face of the piston also includes a plurality of cleats generally near the periphery of the face for grippingly engaging the container during collapsing. A flexible peripheral lip bounds the face of the piston, outside the cleats, with the lip being engageable with the inside of the cylinder for stripping the flexible film-like material of the container away from the cylinder. The piston includes a trailing peripheral skirt portion behind the peripheral lip for stabilizing the piston during movement in the cylinder.

As disclosed herein, the collapsible container of flexible film-like material is generally rectangular in configuration and includes hems along opposite sides thereof. Therefore, the recess means of the contoured face of the piston further may include exaggerated recessed portions for accommodating the additional bulk created by collapsing the hems of the container.

According to a further aspect of the invention, a system is provided for selectively determining a precise metered amount of material to be dispensed by the dispenser for each actuation of the trigger member toward the pistol grip handle. In particular, a set of a plurality of differently configured stop cams are individually and interchangeably positionable between the trigger member and the pistol grip handle to limit movement of the trigger member toward the handle and thereby determine the metered amount of material to be extruded through the opening in the housing for each actuation of the trigger member toward the handle. Each differently configured stop cam is effective to limit movement of the trigger member a degree different from that of the other stop cams in the set thereof.

In the exemplary embodiment of the invention, a selected one of the stop cams is located between the trigger member and the pistol grip handle at a location which prevents removal of the stop cam without dismantling at least one of the trigger member and pistol grip handle, to prevent tampering with the metered condition of the dispenser.

According to still another aspect of the invention, the pistol grip handle projects generally from a side of the housing and is directed generally toward the nozzle end of the housing whereby the dispenser is hand-operated with the housing in a generally vertical orientation. The housing defines a longitudinal axis which, when in use, is a generally vertical axis. The pistol grip handle projects generally at an angle on the order of $43° \pm 5°$ relative to that axis. This orientation of the handle maintains the operator's wrist in an anatomical neutral position during intended use which reduces unnatural forces required to operate the dispenser and reduces fatigue involved in repetitive manual manipulations.

In the exemplary embodiment of the invention, the trigger member also is ergonomically designed, whereby the initial position for squeezing the trigger member is at an angle of $15° \pm 5°$ relative to the aforementioned axis. This angular orientation of the trigger also optimizes the mechanical advantage to generate the necessary forces for dispensing the extrudable material.

The dispenser of the invention further includes several other unique features, including an automatic valve latch which holds the valve open whenever a cover portion of the housing means is removed to maintain the valve in its open condition during loading of a collapsible container therein. A snap-latch feature also may be incorporated in the band-like flexible valve device, operatively associated with the trigger member, for snapping the valve to its closed position in response to the trigger member reaching a given point in its stroke of operation.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 3:
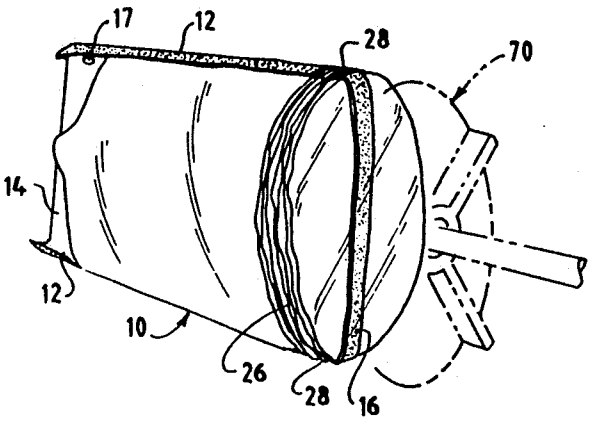
FIG. 3 is a rear perspective view of the pouch-like container in partially collapsed condition.
Figure 2:
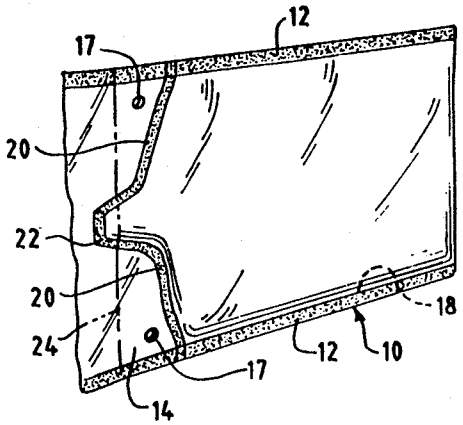
FIG. 2 is a front perspective view of the pouch-like container of FIG. 1.
Figure 1:
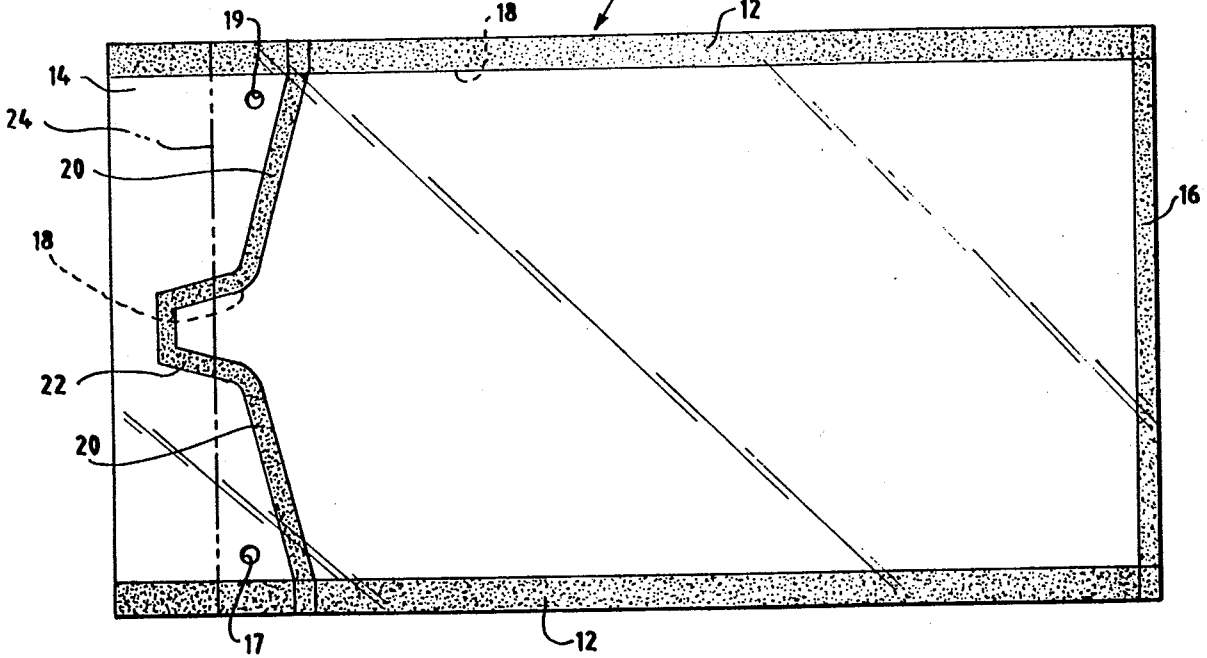
FIG. 1 is a plan view of a pouch-like collapsible container with which the dispenser of the invention is particularly applicable.

Referring to the drawings in greater detail, and first to FIGS. 1–3, the dispenser of the invention is designed for extruding the extruding the extrudable contents of a collapsible container in the form of a generally rectangular pouch, generally designated 10. The container or pouch is designed for dispensing viscous or extrudable contents, such as condiments (e.g. ketchup, mustard, tartar sauce and the like). Of course, it should be understood that the dispenser has a wide variety of applications and uses, other than dispensing condiments, and any such reference or discussions herein are not intended to be limiting.

Container 10 is generally rectangular in configuration as seen particularly in FIGS. 1 and 2. Such pouches conventionally are fabricated by a pair of thin, molded plastic, film-like sheets in mirror-imaged shapes to define an interior cavity for holding a volume of the viscous, extrudable material. The sheets are joined together, as by heating sealing, along side flanges or hems 12 and front and rear flanges or hems 14 and 16, respectively. Front flange 14 has holes 17 adjacent to and inside side flanges 12 for facilitating loading of the container into the dispenser, as described hereinafter. The pouch defines a cavity 18 bounded by side flanges 12, rear flange 16 and heat seals 20 which taper toward a nozzle 22. After loading the container or pouch 10 into the dispenser, front flange 14 is cut, along dotted line 24, the line crossing nozzle 22 so that the nozzle will be opened in response to the cut to establish communication to the interior of cavity 18. Preferably, the plastic film of container 10 is laminated and the plies thereof oriented so that the container can be opened simply by manually tearing along dotted line 24, after the container is loaded into the dispenser described hereinafter.

In order to understand some of the features of the dispenser described hereinafter, reference is made to FIG. 3 wherein container 10 is shown in a hypothetical partially collapsed condition, as would be effected by the dispenser. It can be seen that accordion-like folds 26 are formed about the periphery of the container as the plastic film surrounding cavity 18 is collapsed. In addition, side hems or flanges 12 create further collapsing bulges 28 at opposite sides of the container. In order to ensure that a high percentage of the contents of the container is extruded when empty, and thereby avoid costly waste, provisions are made in the dispenser for effecting substantially the entire evacuation of the container, as described hereinafter, and taking in consideration the profile which the film of the container assumes during collapsing, including accordion folds 26 and bulged areas 28.

Referring now to FIGS. 4–7, the invention is directed to a dispenser, generally designated 30, for dispensing the extrudable contents of a collapsible container, such as container 10 in FIGS. 1–3, with the container having a nozzle, such as nozzle 22, through which the contents can be discharged by collapsing the container. Generally, dispenser 30 includes a housing, generally designated 32, for holding the collapsible container and including a pistol grip handle 34 shown best in FIG. 7. The pistol grip handle projects from a side of the housing at one end thereof opposite an opening 36 (FIG. 5) at an opposite end of the housing at which the nozzle of the container is registrable, as described hereinafter.

More particularly, housing 32 of dispenser 30 includes an elongated lower portion 38, an elongated upper portion 40, a rear plate 42 closing the lower portion, and a front plate 44 closing the entire front of the housing. Upper portion 40 of housing 32 actually forms a cover for the housing and combines with lower portion 38 to define an interior cavity 46 (FIGS. 4 and 7) which effectively defines a cylinder of the housing. The cover is movable from the full line position shown in FIG. 4, in the direction of arrow "A", to the fragmented dotted line position whereat the cover projects upwardly, with the rear end of the cover seated above a rearwardly projection portion 48 of rear plate 42. In essence, lower housing portion 38, rear plate 42 (along with its rearwardly projecting housing portion 48) and front plate 44 form a unitarily rigid structure to which cover 40 is relatively movable between open and closed positions. Rear plate 42 is fixed to the lower housing portion by appropriate fastening means 50 (FIG. 6), and front plate 44 is fixed to the front of the lower housing portion by appropriate fastening means 52 (FIG. 5). It can be seen in FIGS. 5 and 6 that rear plate 42 and front plate 44 have flattened sides (bottoms as viewed in the FIGS.) 42*a* and 44*a*, respectively, for stabilizing the dispenser when positioned and supported on a table, countertop or the like. It should be understood that front and rear plates 44 and 42, respectively, could be molded integrally with lower housing portion 38, obviating fastening means 50 and 52.

Cover 40 is movably mounted relative to lower housing portion 38 by means of a T-shaped boss 54 (FIG. 4) defining forwardly and rearwardly projecting lips 54*a* and 54*b*, respectively. In the closed position of cover 40, forwardly projecting lip 54*a* seats beneath a latch boss 56 projecting outwardly from the side of lower housing portion 38. In addition, a pair of pins 58 project forwardly of the cover and are slip fit within complementary holes 60 in front plate 44. It should be understood that one T-shaped boss 54, one latch boss 56, one pin 58 and one hole 60 are provided on each opposite side of the dispenser. To facilitate opening and closing of cover 50, a pair of pins 62 project inwardly from rearwardly projecting lips 54*b* for movement into L-shaped slots 64 formed in opposite sides of the lower housing portion. Each slot includes a generally horizontal leg 64*a* communicating with a generally vertical leg 64*b*.

Figure 4:
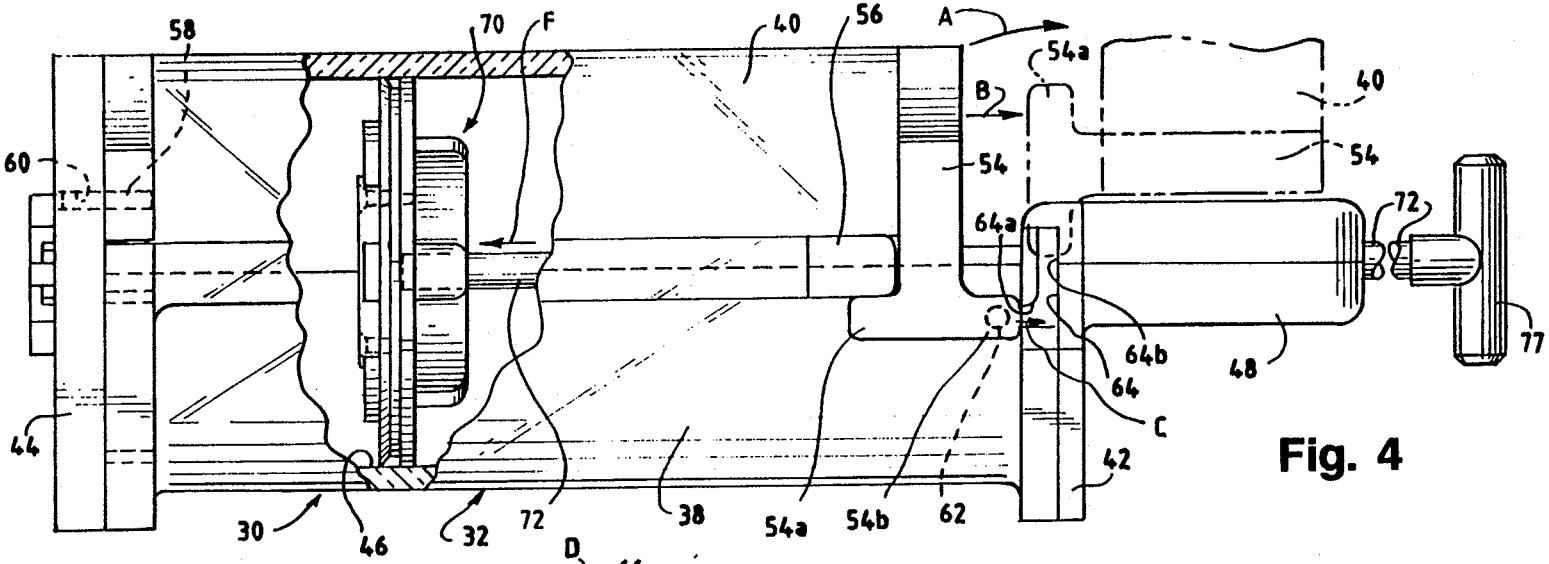
FIG. 4 is a side elevational view of the dispenser of the invention, partially broken away and in section to show the piston therewithin, and with a portion of the top cover shown in dotted lines in its raised or open position.
Figure 6:
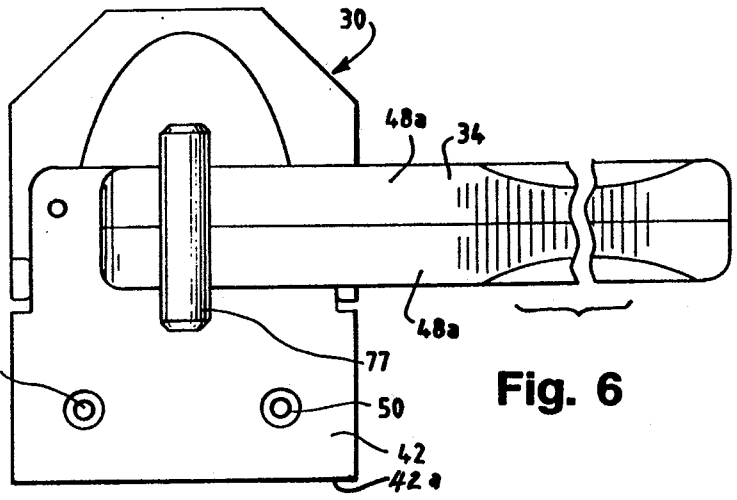
FIG. 6 is a rear elevational view looking toward the right-hand end of FIG. 4.
Figure 5:
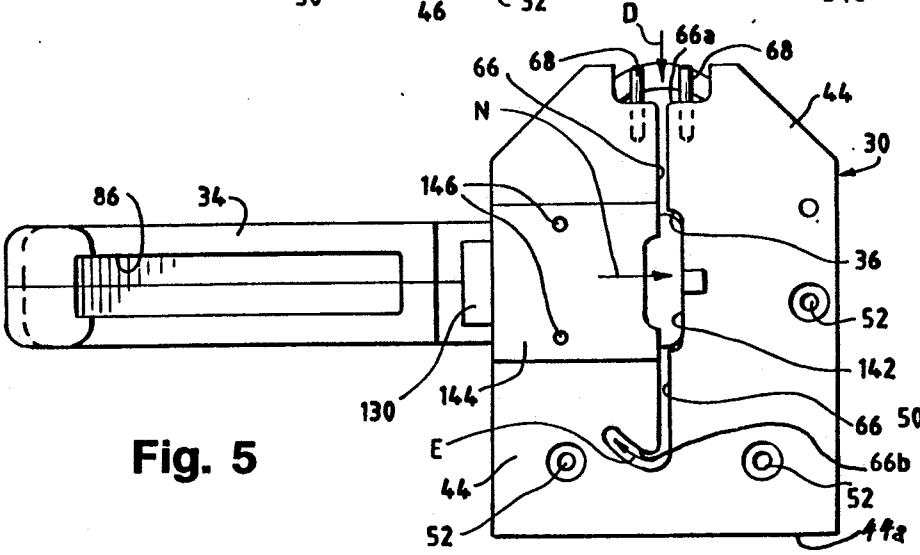
FIG. 5 is a front elevational view looking toward the left-hand end of FIG. 4.

When it is desired to open the dispenser by moving cover 40 from its closed position shown by full lines in FIG. 4 to its open position shown by dotted lines therein, the cover is moved rearwardly in the direction of arrow "B". This releases pins 58 from their slip fit within holes 60 and also moves forwardly projecting lips 54a from beneath latch bosses 56. In addition, pins 62 move into horizontal legs 64a of slots 64, as indicated by arrow "C". The cover then can be lifted slightly, then rotated in the direction of arrow "A", whereupon pins 62 ride upwardly in legs 64b of slots 64 until the cover assumes its open position as shown by dotted lines in FIG. 4. The interior cavity or cylinder of the housing now is fully accessible for loading one of the containers 10 (FIGS. 1-3) thereinto.

At this point, reference is made particularly to FIG. 5 wherein it can be seen that a vertical slot 66 is formed in front plate 44, the slot having an open mouth 66a at the top thereof and a hooked portion 66b at the bottom thereof. Actually, opening 36 of the dispenser is formed by an enlarged section or area of slot 66. In loading a container 10 into the dispenser, front flange or hem 14 of the container is slid downwardly into slot 66, in the direction of arrow "D". When the lower portion of the front hem reaches the bottom of the slot, the hem is curved upwardly and forced into hooked portion 66b of the slot, as in the direction of arrow "E". When fully seated in the slot, one of the holes 17 (FIG. 1) is positioned over one of a pair of pins 68 located on opposite sides of the slot as shown in FIG. 5. The container then is fully loaded within the lower housing portion 38 of the dispenser, and cover 40 can be pivoted downwardly and moved to its closed position, opposite the sequence described above for opening the cover.

Figures 7, 8:
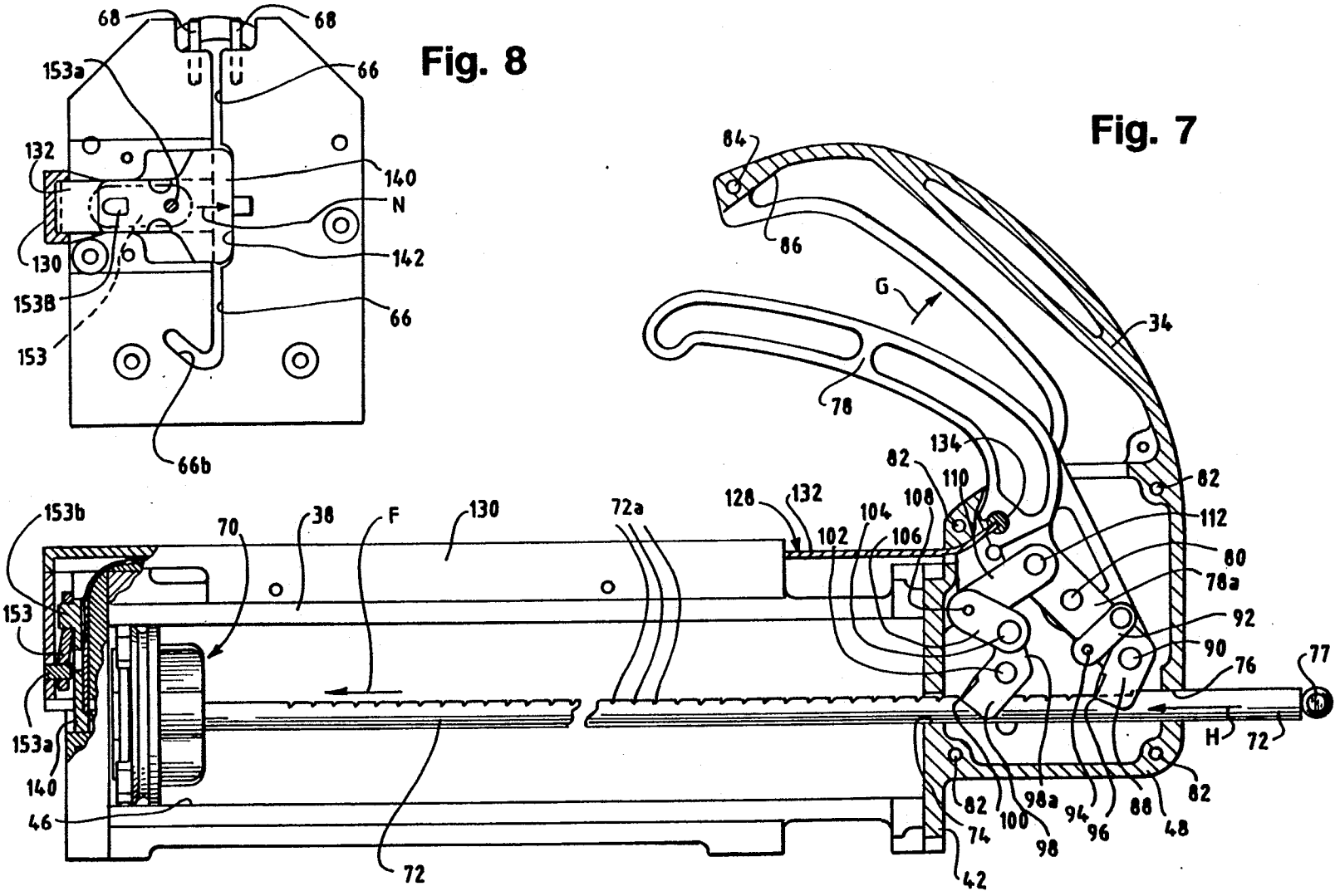
FIG. 7 is a top plan view of the dispenser, partially fragmented and in section, with the cover removed to facilitate the illustration.
FIG. 8 is a front elevational view of the dispenser, with the front plate of the housing removed to facilitate the illustration.

An extruding member in the form of a piston, generally designated 70, is movably mounted within cylinder 46 of housing 32 for engaging the container remote or rearwardly of the container's nozzle, at the rear end of the container opposite opening 36 (FIG. 5) of the housing. The piston is secured to the front distal end of a piston rod 72, as best seen in FIG. 7. The rod has a series of ratcheting notches 72a on one side thereof for incrementally ratcheting the piston and piston rod forwardly in the direction of arrow "F" by advancing means described hereinafter. The piston rod projects rearwardly through an opening 74 in rear housing plate 42 and an opening 76 in the rear housing portion of the plate, and the rear distal end of the piston rod is provided with a handle 77 for manually grasping and retracting the piston back to the rear of cylinder 46 after a container is completely evacuated, or at any time as desired by an operator.

Generally, advancing means are operatively associated with piston 70, through piston rod 72, for moving the piston relative to the housing in the direction of arrow "F" and advancing the piston toward opening 36 for extruding the contents of the collapsible container. More particularly, the advancing means includes a trigger 78 shown best in FIG. 7, the trigger being movable toward pistol grip handle 34 in the direction of arrow "G", as by gripping by a hand of an operator. The trigger is pivoted, at 80, within rearwardly projecting housing portion 48 of rear housing plate 42. At this point, it should be understood that the rearwardly projecting housing portion 48 of rear plate 42 actually includes two halves 48a (see FIG. 6) which are secured together by appropriate fastening means 82 (FIG. 7) for assembling the various components of the advancing means (described hereinafter) therewithin. In addition, it can be seen particularly in FIG. 7 that pistol grip handle 34 actually is an integral part of housing portion 48 and, itself, is "split" or formed by two halves secured together by appropriate fastening means 84. Lastly, the handle has an open area 86 on the inside thereof and within which trigger 78 is movable, as described hereinafter.

Still referring to FIG. 7, various links, pawls and springs interconnect trigger 78 to piston rod 72 in an operative manner for incrementally advancing the piston rod and piston 70 forwardly within cylinder 46 in the direction of arrow "F". More particularly, a drive pawl 88 is pivotally mounted to an end 78a of trigger 78 on an opposite side of the trigger pivot 80. The pawl is pivoted to the trigger, at 90, and includes a "bell crank" portion to which an elastomer strap spring 92 is engaged at one end thereof, with the opposite end of the strap spring being fixed to a pin 94 on the trigger end. The drive pawl engages within ratcheting notches 72a of piston rod 72 at a point 96 which is overcenter of pivot 90 in a forward direction. Therefore, as trigger 78 is squeezed in the direction of arrow "G", the drive pawl will "bind" into one of the ratcheting notches and incrementally drive the piston rod forwardly in the direction of arrow "H". On release of the trigger, the drive pawl will ride rearwardly along the piston rod to the next ratcheting notch whereupon strap spring 92 biases the pawl into the notch.

The advancing means also includes stop means for preventing piston rod 72 and piston 70 from backing-up during each incremental advancement thereof by squeezing trigger 78. More particularly, a stop pawl 98 is engageable in the ratcheting notches, as at 100. The stop pawl is pivoted within rear housing portion 48, at 102. The stop pawl, like the drive pawl, has a "bell crank" configuration and includes a portion 98a on the opposite side of pivot 102, which is pivoted, at 104, by an elastomer strap spring 106 which, in turn, is pivoted within the housing portion, at pin 108. In operation, as trigger 78 advances piston rod 72 forwardly in the direction of arrows "F" or "H", stop pawl 78 simply rides over the piston rod and its ratcheting notches. However, should there by any force biasing the piston rod in a rearward direction, the stop pawl will engage within a ratchet notch, as at 100, and prevent backing off of the piston. Preferably, the configuration and spacing of drive pawl 88 and stop pawl 98 are such that the stop pawl will snap into a ratcheting notch under the biasing of strap spring 106 for each incremental advancement of the piston. Lastly, a third elastomer strap spring 110 extends between pin 108 and another pin 112 on trigger 78 to bias the trigger toward its inoperative position as shown in FIG. 7.

Referring to FIGS. 11-15, a unique feature of the invention is the construction of piston 70 whereby the piston is effective for extruding an extremely high percentage of the extrudable material from collapsible container 10 (FIGS. 1-3). Before proceeding with a description of the construction of the piston, a brief review of the profile of the collapsed container shown in FIG. 3 is warranted. As stated above, when the container is collapsed, the flexible film-like plastic material about the periphery of the container collapses in a ring-like, accordion-like fashion as represented by accordion folds or pleats 26 in FIG. 3. In addition, additional bulky areas 28 are created at opposite sides (i.e. the top and bottom when positioned within the dispenser) of the collapsed container. However, the rear of the container which is initially engaged by the piston in the central area of the collapsed container is formed by a substantially single thickness of the flexible film of the container.

With the above understanding, piston 70 includes a composite container-engaging face having a contoured structure corresponding generally to the collapsed (or collapsing) profile of container 10 as shown in FIG. 3 and described above. More particularly, with reference to FIGS. 11–15, the contoured structure of the composite container-engaging face of piston 70 includes a circular, flat central portion 114 which projects forwardly or toward the container. This central portion will engage the substantially single film thickness area at the rear end of the collapsing container. Recessed areas 116 bound central portion 114 to provide reliefs for accommodating the accordion-like folds or pleats 26 (FIG. 3) formed about the collapsible container during collapsing thereof. Exaggerated or enlarged recessed areas 118 are formed at the top and bottom of the container-engaging face of the piston for accommodating the additional bulging portions 28 (FIG. 3) of the collapsing container. In other words, recessed areas 118 are "deeper" in relation to central portion 114 than are recessed areas 116. In addition, the contoured structure of the composite container-engaging face of piston 16 includes a plurality of cleats 120 near the periphery of the piston face for grippingly engaging the container during collapsing thereof. In essence, the cleats are effective to "grab" and drag the bag during collapsing and assist or direct accordion folds 26 to create a more predictable pattern as to where the folds begin and where they are to accumulate. The cleats ensure that the accordion folds do not open up or elongate and pass about the piston. In essence, the cleats ensure that the accordion pleats are regularly formed rather than randomly bunched.

Still further, piston 70 includes a flexible peripheral lip 122 which is engageable with the inside of cylinder 46 (FIGS. 4 and 7) for stripping the flexible film-like material of the container away from the walls of the cylinder so that the film does not bind between the piston and the cylinder walls. The piston also includes a trailing peripheral skirt portion 124 which rides along the interior cylinder walls for stabilizing the piston during its movement within the cylinder and to provide a uniform compression of flexible peripheral lip 22 about the periphery of the piston.

Figure 16:
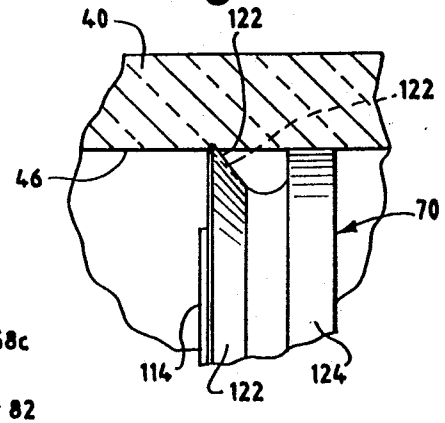
FIG. 16 is an enlarged fragmented and partially sectioned view to illustrate the flexible lip of the piston.

Preferably, at least the contoured face of piston 70 can be unitarily molded of fairly rigid plastic material. The tapered structure of flexible peripheral lip 122 can be integral with the piston rather than being a separate component. For instance, FIG. 16 shows lip 122 in full lines in its decompressed condition and in dotted lines in its compressed condition for wiping against the interior walls of cylinder 46, as skirt portion 124 rides along the cylinder walls and guides the piston.

Figures 11, 12, 13, 14, 15:
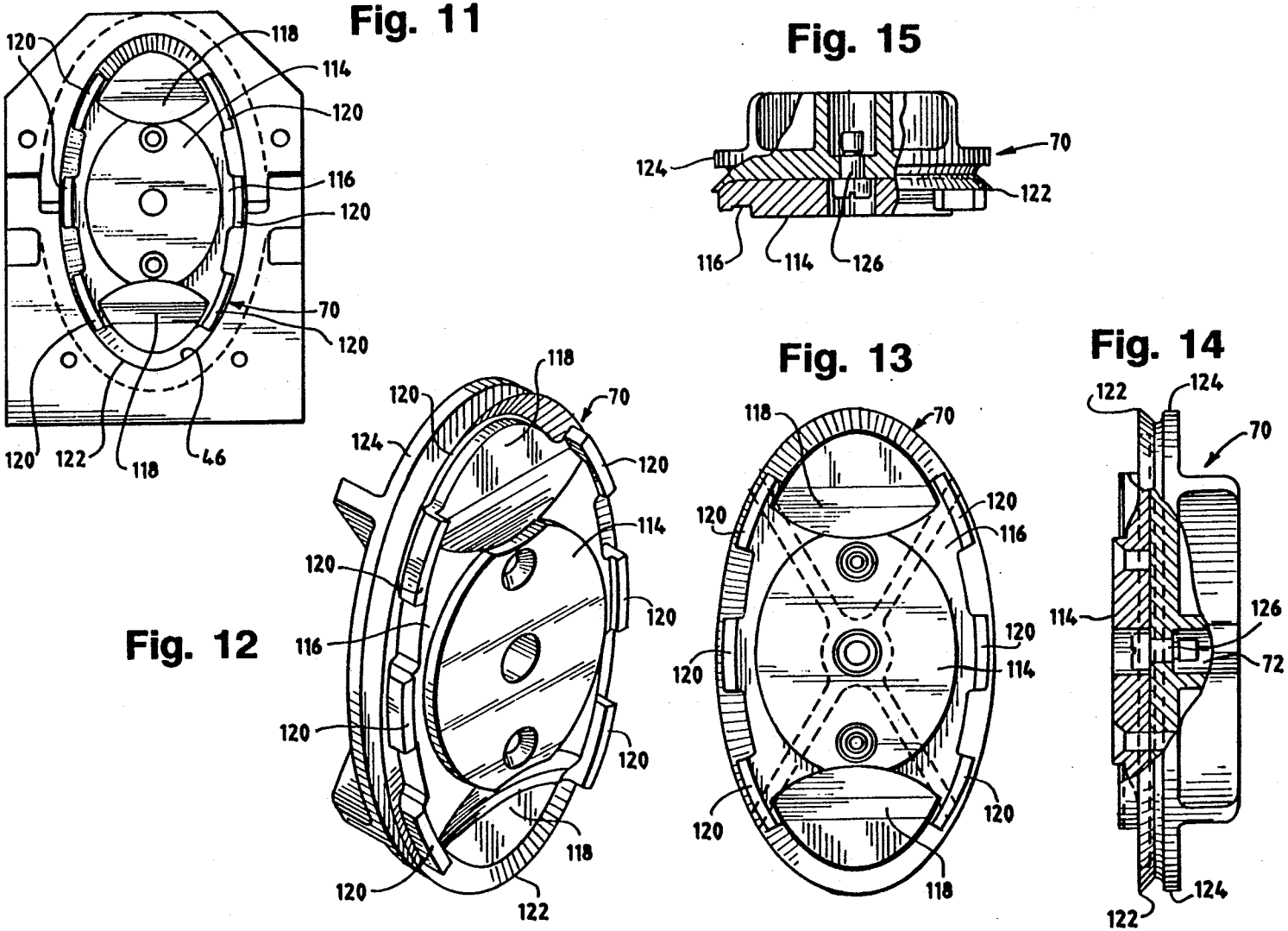
FIG. 11 is a front elevational view of the dispenser with the front plate of the housing and the valve components completely removed to show the interior of the cylinder defined by the housing and the front contoured face of the piston.
FIG. 12 is a perspective view of the piston of the dispenser.
FIG. 13 is a front elevational view of the piston.
FIG. 14 is a side elevational view of the piston, partially cut away and in section.
FIG. 15 is a top plan view of the piston, partially cut away and in section.

FIG. 15 shows that piston 70 is fixed to the distal end of piston rod 72 by means of a shoulder screw 126 which allows some play between the piston and the piston rod to allow for rotation of the piston rod relative to the piston, so that the rod can be rotated to disengage ratchet notches 72*a* and retract the piston. Lastly, reference is made to FIG. 11 wherein it can be seen that cylinder 46 and piston 70 are elliptical in transverse configuration for accommodating container 10 which originally is in a rectangular configuration until the container is filled, whereupon the container assumes a more elliptical than round configuration.

FIG. 11 shows that there is a longitudinal gap between the upper and lower housing portions at opposite sides thereof. These gaps prevent the film of pouch 10 from being clamped or pinched between the housing portions.

Figures 9, 10:
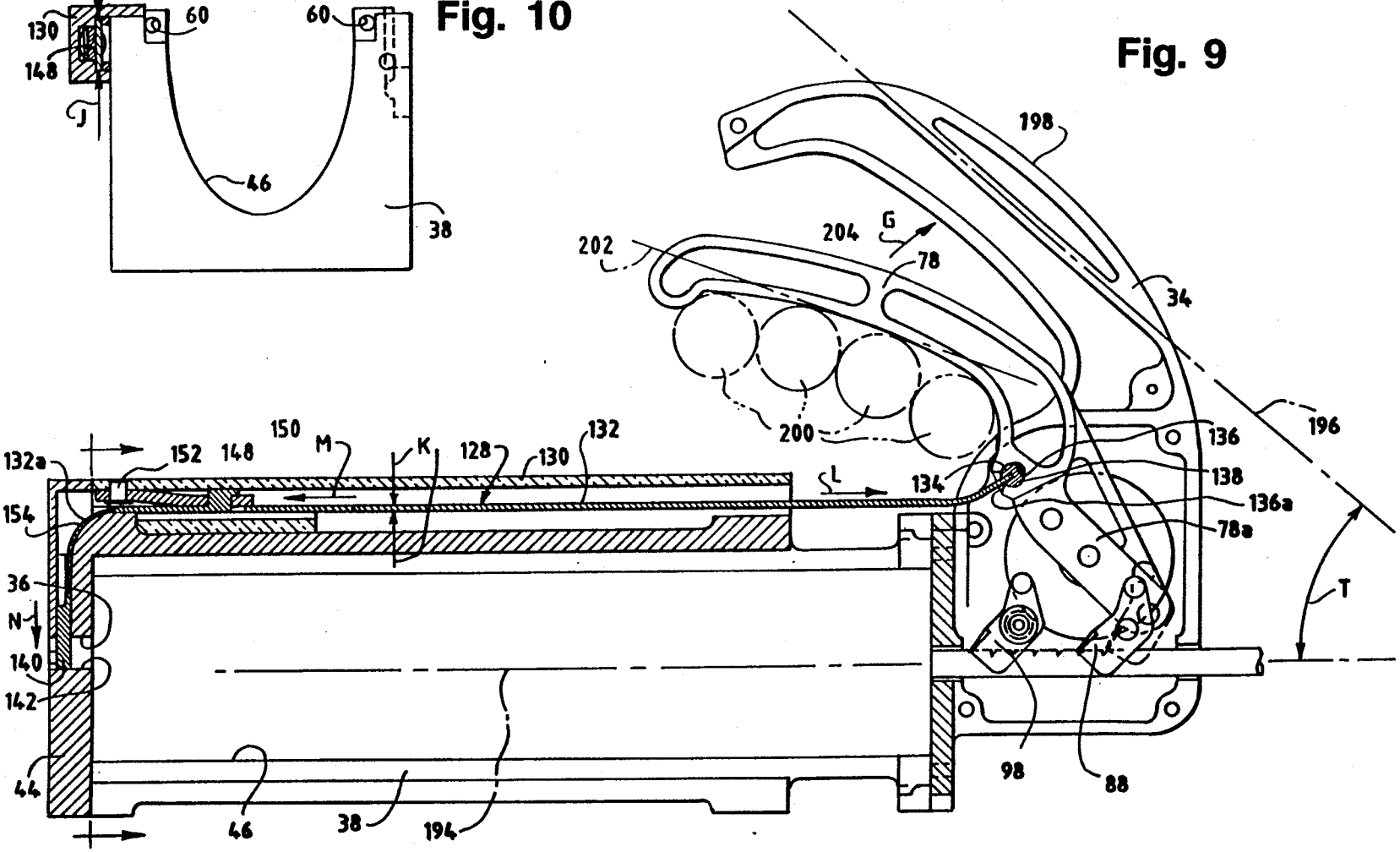
FIG. 9 is a view similar to that of FIG. 7, with some of the components removed, with portions of the housing sectioned to show the flexible band-like valve member, and showing an alternate, side location for the strap spring for the valve.
FIG. 10 is a section taken generally along line 10—10 of FIG. 9.

Referring to FIGS. 9 and 10 in conjunction with FIGS. 5, 7 and 8, the invention contemplates that trigger 78 be operatively associated with an elongated flexible valve device, generally designated 128 (FIG. 9), which is slidably mounted within an enlarged portion 130 of lower housing portion 38. The elongated flexible valve device is a thin band-like member 132 unitarily molded of plastic material which has a given width, as indicated by dimensional arrows "J" in FIG. 10, and a given thickness as indicated by dimensional arrows "K" in FIG. 9. Therefore, the band is relatively rigid in its width direction but considerably flexible in its thickness direction. The band is coupled to trigger 78 by a coupling end 134 which is enlarged and received in a socket 136 in the trigger. Therefore, when the trigger is squeezed in the direction of arrow "G", the band will be drawn rearwardly in the direction of arrow "L". With the band having a given width "J" (FIG. 10), enlarged portion 134 is generally cylindrical in shape and socket 136 is also generally cylindrically shaped with a reduced dimensioned mouth 136 to capture the enlarged portion of the band within the socket. Preferably, the socket is slightly larger than the enlarged portion, as at 138 (FIG. 9) to provide some lost motion between the trigger and the band-like valve device for assembly tolerance purposes. Enlarged portion 134 could be an integrally molded end of the band-like valve device, or it may be a separate portion, as shown, and integrally affixed to the band-like valve device by epoxy or the like.

Band 132 has an enlarged portion 140 at its opposite end to define a valve end of the elongated flexible valve device 128. Enlarged portion 140 is both thicker and wider than band 132 as best seen in FIG. 8. In essence, the enlarged portion defines a valve for engaging a valve seat 142 defined by opening 36. Nozzle 22 (FIG. 1) of collapsible container 10 is pinched between valve 140 and valve seat 142. A valve cover 144 (FIG. 5) is fixed to front housing plate 44 by appropriate fastening means 146 for enclosing the valve area of the dispenser. Enlarged valve portion 140 could be an integrally molded end of band 132, or it may be a separate portion, as shown, and integrally fixed to the band by epoxy or the like.

As best seen in FIGS. 9 and 10, a spring means in the form of an elastomer strap spring 148 is interconnected between an outwardly projecting boss 150 of band 132 and a pin 152 fixed to housing portion 130. The strap spring is effective to bias band 132 in a forward direction as indicated by arrow "M" (FIG. 9), and to bias valve 140 to its closed position against valve seat 142 in the direction of arrows "N" (FIGS. 5, 8 and 10). Strap spring 148 at the side of the dispenser as seen in FIGS. 9 and 10, is an alternate embodiment or location. A preferred location is shown in FIGS. 7 and 8 wherein a strap spring 153 may be employed and anchored between an integral pin 153*a* of band 132 and a boss 153*b* of front plate 44 to bias valve 140 to its closed position.

Therefore, in operation, as trigger 78 is squeezed in the direction of arrow "G", valve 140 is opened through the means of band 132. When the trigger is released, strap spring 110 biases the trigger back to its inoperative position, and strap springs 148 and 153 bias valve 140 to its closed position against valve seat 142. By having valve 140 interconnected to trigger 178 in an interrupted fashion through band 132, a very precise opening and closing of the valve is effected in direct response to movement of the trigger, thereby providing a precise metering of extruded material correlated to the operation of piston 70 which is operatively associated directly to the trigger. This has not been afforded by prior art linkages wherein various link arms or other components are located in the drive train between the trigger and the valve, versus the continuous unitary motion afforded by band 132.

Lastly, again as best seen in FIG. 9, it can be seen that band 132 moves around a corner 154 of the lower housing portion and front housing plate 44. In order to increase the flexing capability of band 132, it can be seen that the band is molded thinner in this bent area, as at 132*a*, to provide ease of movement of the overall elongated flexible valve device 128 and to extend the flex life thereof.

FIGS. 17–20 shows a feature of the invention which incorporates a system for selectively determining a metered amount of material to be dispensed by dispenser 30 for each actuation of trigger 78 toward pistol grip handle 34. More particularly, a set of a plurality of differently configured stop cams 156 (FIG. 17) and 158 (FIGS. 18 and 19) are individually and interchangeably positionable between the trigger and the pistol grip handle to determine the metered amount of material to be extruded through opening 36 for each actuation of the trigger toward the handle. More particularly, stop cam 156 is shown mounted within an interior cavity area 160 of pistol grip handle 34. This can be accomplished by press fitting a pin portion 158*d* (FIG. 19) in a complementary hole in the handle. Stop cam 156 defines a stop surface 156*a* which is engageable by the trigger to define a limit position of squeezing the trigger. Through experimentation or calculation, the precise location of this stop surface can be correlated to a given amount of desired material to be extruded from the collapsible container. For instance, stop cam 156 has a raised boss portion 156*b* having the indicia "½", as at 156*c*, which represents that one-half ounce of material will be dispensed for each actuation of the trigger if the trigger is moved to a point represented by stop surface 156*a*.

Figure 19:
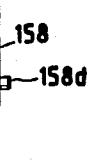
FIG. 19 is an elevational view looking toward the right-hand side of FIG. 18.
Figure 18:
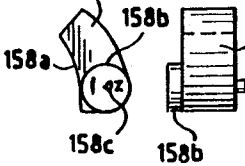
FIG. 18 is a view of a stop cam of a different size than that shown in FIG. 17.
Figure 17:
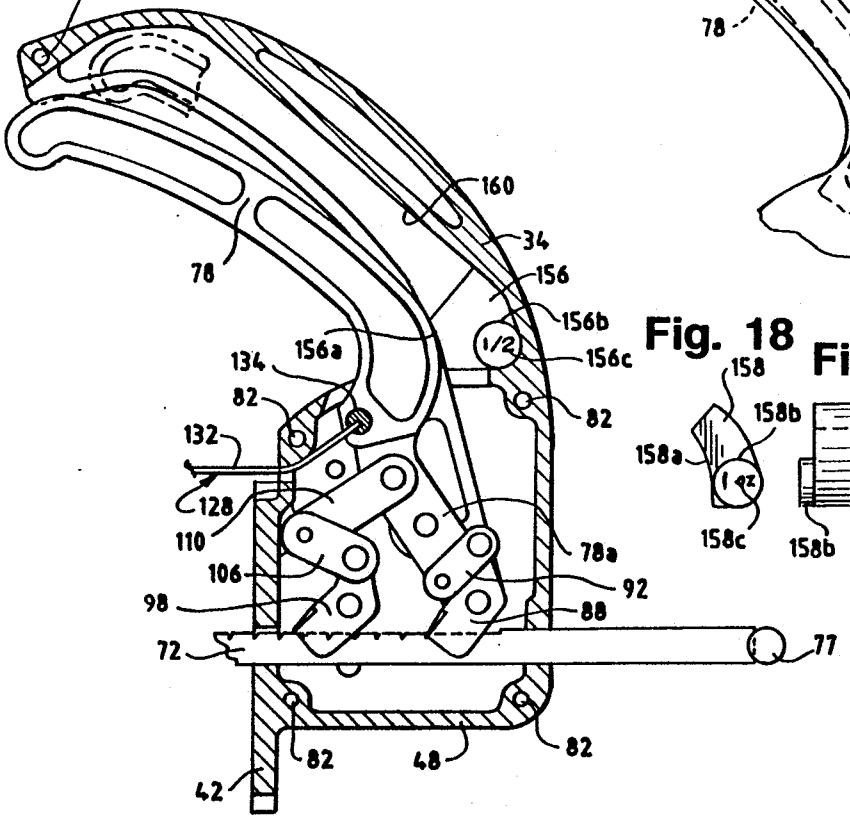
FIG. 17 is a view similar to the right-hand end of FIG. 7, showing the interchangeable stop cam feature of the invention.

Now, referring to FIGS. 18 and 19, it can be seen that the stop cam 158 shown therein is of a different or narrower configuration to define a stop surface 158*a* engageable by trigger 78. In comparing stop cam 158 with stop cam 156 (FIG. 17), it can be seen that stop surface 158*a* will allow the trigger to move further toward pistol grip handle 34 than will stop surface 156*a*. Therefore, the trigger will have a greater stroke which, effectively, will move piston rod 72 and piston 70 a greater linear distance to extrude a greater amount of material. Stop cam 158 has a raised boss portion 158*b* having the indicia "1 oz.", as at 158*c*, which represents that one ounce of material will be dispensed for each actuation of the trigger if the trigger is moved to a point represented by stop surface 158*a*.

Of course, it should be understood that more than two stop cams, such as stop cams 156 and 158, can be provided in a set thereof to effect different amounts of metered material to be dispensed by the dispenser. In addition, the size of the cams should be complementary to the pitch of ratchet notches 72*a*.

It is contemplated that the metering system afforded by stop cams 156 and 158 can be used to precondition dispenser 30 for incremental metering of given amounts of material without allowing tampering of the "setting" of the dispenser. For instance, as stated above, quality control is very important in high volume restaurants or similar establishments to maintain control of the precise "recipes" of the food products. Consequently, it can be seen in FIG. 17 that the stop cams are located within the interior cavity area 160 of pistol grip handle 34 and cannot be removed therefrom because of pins 158*d* (FIG. 19) and the fact that the pistol grip handle is assembled in two halves, as described above. Consequently, the dispenser would have to be somewhat dismantled or disassembled before the metering precondition can be changed, which is unlikely in actual practice.

Figure 20:
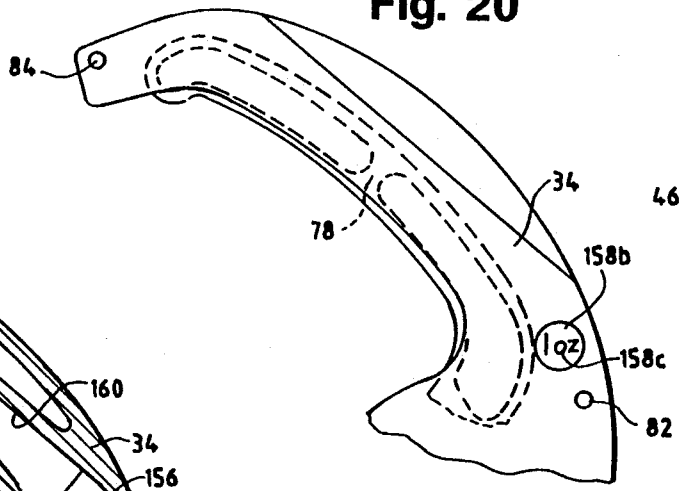
FIG. 20 is a fragmented view of the pistol grip handle and trigger member in relative closed condition, employing the stop cam of FIGS. 18 and 19.

Lastly, FIG. 20 simply shows that pistol grip handle 34 can have a window 164 therein through which the indicia 156*c* (or 158*c*) is visible from the exterior of the dispenser. Therefore, an operator simply can look through the window and see the precise preconditioned setting of the dispenser.

Figure 21:
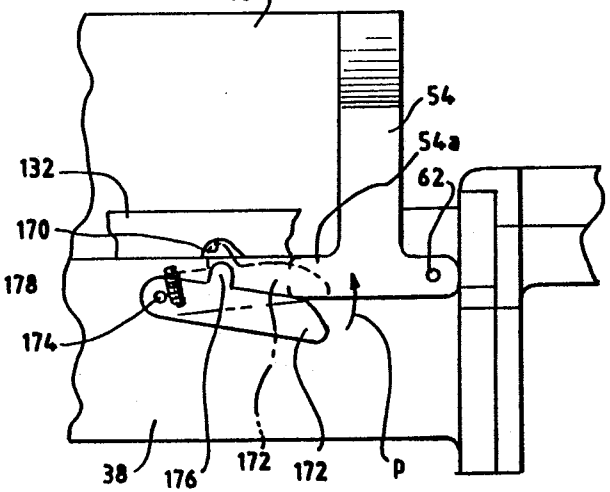
FIG. 21 is a fragmented view showing an alternate form of the invention incorporating a valve latch feature between the housing and the flexible band-like valve device.

Referring to the fragmented view of FIG. 21, an alternate feature of the invention is shown wherein valve 140 (FIG. 9) can be maintained in an open position when cover 40 (FIG. 4) is opened, and whereby the valve is automatically closed in response to fully closing of the cover. More particularly, FIG. 21 shows a section of band 132 of elongated flexible valve device 128, with the band including a detent notch 170 in one edge thereof. A detent pawl 172 is pivotally mounted, as at 174, to the outside of the lower housing portion 38, whereby a detent locking tab 176 is positionable for movement into and out of detent notch 70. An appropriate spring means 178 may be mounted between pawl 172 and the lower housing portion for biasing the pawl upwardly in the direction of arrow "P". It can be seen in FIG. 21 that, when cover 40 is in its closed position, forwardly projecting lip 54*a* blocks upward movement of pawl 172 so that tab 176 cannot engage within notch 170. The notch is positioned at a location in band 132 for alignment with tab 176 when trigger 78 is squeezed to open valve 140.

In operation of the automatic valve latch shown in FIG. 21 and described above, cover 40 first is moved to its open position for allowing access to the interior of the dispenser housing for loading a new collapsible container therewithin. Trigger 78 is squeezed to move notch 170 in band 132 into alignment with tab 176. With lip 54*a* being moved out of blocking engagement with detent pawl 172, tab 176 of the pawl is automatically biased into notch 170. When the trigger is released, the interengagement of the tab within the notch is effective to hold valve 140 open so that the front flange 14 (FIGS. 1 and 2) of a new collapsible container can be stripped into slot 66 (FIGS. 5 and 8), as described above, without the valve blocking the slot. When the new container is fully loaded into the lower portion of the dispenser housing, cover 40 is moved back to its closed position, whereupon lip 54*a* of the cover engages detent pawl 172 and moves tab 176 out of notch 170 in the valve band. Spring 148 (FIG. 9) and spring 153 (FIG. 8) then are effective to automatically close the valve, i.e. automatically in response to positioning the cover in its closed position.

Figures 22, 23, 24:
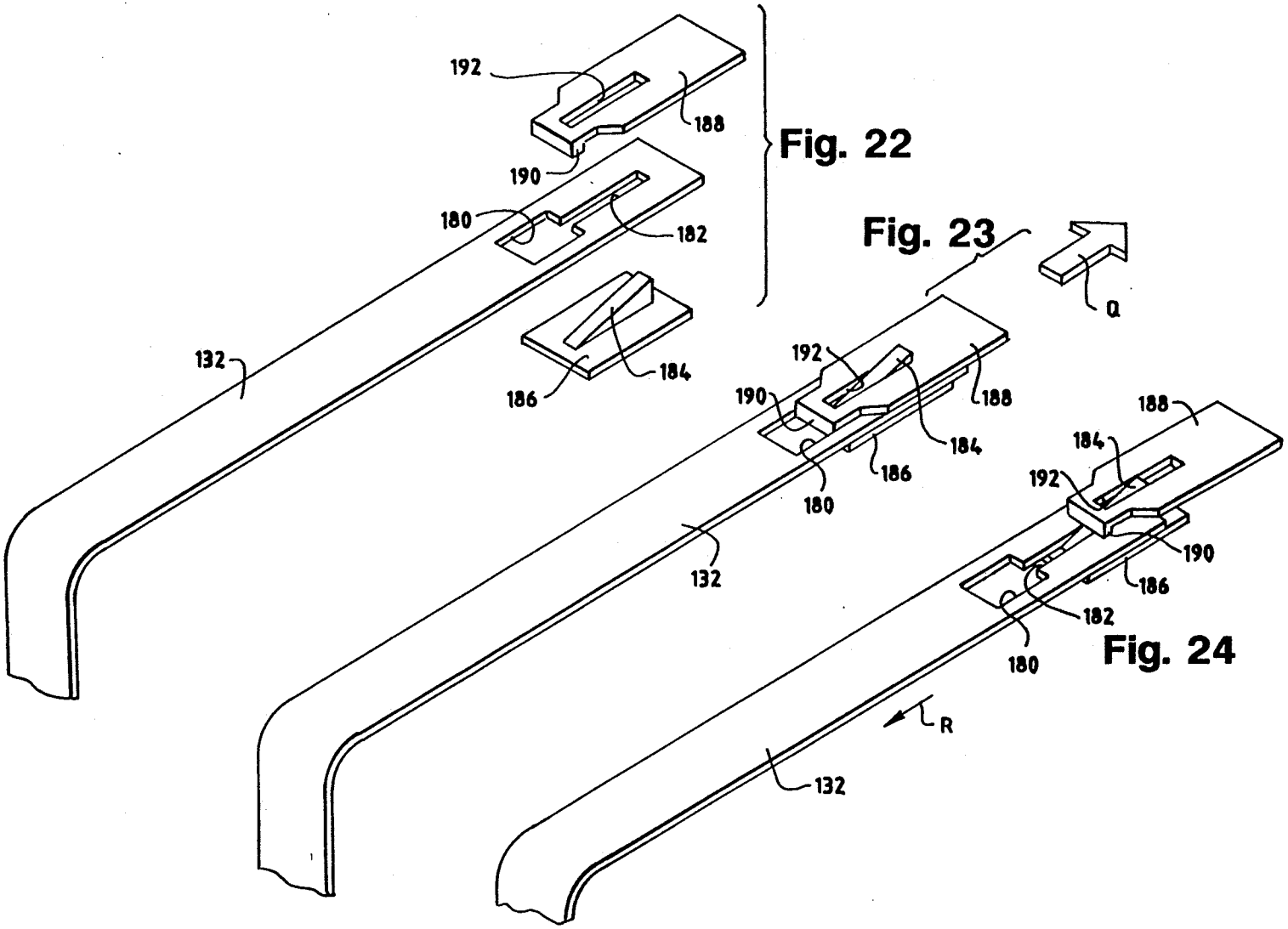
FIG. 22 is a perspective view of the rear end of the band-like valve device, incorporating an alternate form of the invention comprising a snap-closing feature of the invention.
FIG. 23 is a view similar to that of FIG. 22, with the components in assembled condition for actuation of the valve.
FIG. 24 is a view similar to that of FIG. 23, with the components in a released condition for allowing the valve to snap to its closed position.

FIGS. 22–24 show another alternative feature of the invention which may be incorporated in dispenser 30.

This feature involves an automatic snapping of valve 140 to its closed position automatically when trigger 78 reaches a predetermined point in its actuating path of travel. More particularly, FIG. 22 shows band 132 with a keyhole-shaped cutout at the rear end thereof, the cutout including an enlarged opening 180 communicating with an elongated slot 182. A ramp 184 is shown integral with a base portion 186. The base portion actually may be part of lower housing portion 38, or the base may be a separate adjustable member, as described hereinafter. Ramp 184 is configured for projecting through slot 182 in band 132. A keeper member 188 is appropriately fixed to trigger 78 for movement therewith. Keeper member 188 has a flange or pawl 190 which projects into opening 180 in band 132, along with an elongated aperture 192 into which ramp 184 extends.

Now, referring to FIG. 23, the assembled condition of the components described above in FIG. 22 is shown. It can be seen that flange 190 projects into opening 180 to lockingly engage within the opening at each side of slot 182 (FIG. 22). Therefore, as the trigger pulls on member 188, in the direction of arrow "Q", the trigger will pull band 132 therewith to open the valve of the dispenser. Continued movement of the trigger, pulling on member 188, causes flange 190 to begin to ride up ramp 184 which remains fixed relative to the dispenser housing. Eventually, upon reaching a given point predetermined by design, ramp 184 acts as a release means and will bias flange 190 clear of opening 180 in band 132, as shown in FIG. 24, whereupon the band will snap back in the direction of arrow "R" and automatically close the valve under the influence of elastomeric spring 148 (FIG. 9) and spring 153 (FIG. 8). When the trigger is released, with member 188 fixed to the trigger, the member will move back forwardly and cause flange 190 to move back into opening 180 in band 132 for the next cycle of operation.

It is contemplated that the automatic snap-action valve closing mechanism, described above in relation to FIGS. 22-24, be adjustable to snap the dispenser valve to its closed position at varying points in the stroke or path of travel or trigger 78. This simply would be accomplished by providing base 186 and ramp 184 as a separate unit and by fastening the unit to the dispenser housing by appropriate adjustable fastening means, such as screws or bolts extending into elongated slots in base 186.

Lastly, it is known in the field of Ergonomics that early fatigue can set in for individuals involved in repetitive manual movements or manipulations when the individual's hands, wrists, arms and the like are used in extreme or awkward postures. For instance, when an individual extends the lower arm, wrist and hand outwardly in a relaxed, normal or "neutral" posture, the closing of the individual fingers against the palm of the hand creates a pocket which is at an angle to the neutral line of the lower arm. The invention contemplates that pistol grip handle 34 be configured relative to dispenser housing 32 in an orientation approximately at, or as close as possible to, the neutral conditions of an operator's hand, wrist and arm when using dispenser 30 of this invention.

More particularly, referring to FIG. 9, a longitudinal axis 194 defines the vertical axis of orientation of the dispenser in actual use. In other words, opening 36 and valve 140 at the front end of the dispenser normally will be pointed downwardly for depositing the extruded material from collapsible container 10 toward its intended location, such as on top of a food product: for example depositing an incremented amount of ketchup onto a sandwich. Pistol grip handle 34 can be seen to be projecting outwardly from the dispenser and directed generally toward the dispensing end thereof. In other words, the handle would be canted downwardly for grasping by an operator. Line 196 in FIG. 9 represents the axis of the handle, taking in consideration that the handle is bowed outwardly, as at 198, in a convex shape. The invention contemplates that the general axis 196 of pistol grip handle 34 be located at an angle relative to longitudinal axis 194 of the dispenser, as represented by double-headed arrow "T", which is on the order of $43° \pm 5°$. This orientation will maximize the ergodynamic posture range of normal operators of the dispenser.

Still further, Ergonomics dictate that premature fatigue can set in when an individual's fingers are spread too far apart from the palm when initiating a gripping motion under repetitive movement conditions. Conversely, if the fingers are used in repetitive movements in a range limited too closely to the palm, premature fatigue also can set in.

Referring again to FIG. 9, circles 200 represent the four fingers of an operator's hand, the operator's palm being engageable with outwardly bowed surface 198 of pistol grip handle 34. Consequently, the invention contemplates that a line 202 which passes generally through or at least tangentially to gripping surface 204 of trigger 78 be on the order of an angle of $15° \pm 5°$ to axis 194 of the dispenser when the trigger is in its inoperative position, i.e. at the beginning of its squeezing action. This angular orientation of the trigger also optimizes the mechanical advantage to generate the necessary forces for dispensing the extrudable material.

With the above angles of pistol grip handle 34 and trigger 78, dispenser 30 can be maintained in a generally vertical orientation while keeping the operator's arm, wrist and hand in an anatomically neutral position to reduce premature fatigue under repetitive actuations of the dispenser.

Lastly, as stated above, the outer gripping surface 198 of piston grip handle 34 has a gradual convex, outwardly bowed shape. Therefore, the handle has a "high spot" or a largest dimension intermediate the ends of the handle. This facilitates an operator to maintain his or her hand centered on the handle and the trigger and not to drift toward one end or the other which, also, would create muscular fatigue as the operator, otherwise, would continue to manipulate the dispenser to maintain a comfortable gripping posture.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A dispenser for dispensing the extrudable contents of a collapsible container having a nozzle through which the contents can be discharged by collapsing the container, comprising:

housing means for holding the collapsible container, including a pistol grip handle at one end of the housing means and an opening at an opposite end of the housing means at which the nozzle is registrable;

an extruding member movably mounted in the housing means for engaging the container remote from the nozzle;

advancing means operatively associated with the extruding member for moving the extruding member relative to the housing means for advancing the extruding member toward the opening for extruding the contents of the collapsible container, including a trigger member movably mounted adjacent the pistol grip handle to incrementally advance the extruding member for each actuation of the trigger member to effect a metered dispensing of the contents of the container; and an elongated flexible valve device slidably mounted relative to the housing means and including a coupling end coupled directly to the trigger member and a valve end for opening and closing said opening in response to movement of the trigger member.

2. The dispenser of claim 1, including means mounting the trigger member immediately adjacent the pistol grip handle for conjoint gripping therewith.

3. The dispenser of claim 1 wherein said elongated flexible valve device comprises a one-piece thin band member of plastic material with the coupling end and the valve end thereof being integral therewith.

4. The dispenser of claim 1 wherein said elongated flexible valve device comprises a band member of plastic material with the coupling end being integral therewith.

5. The dispenser of claim 4 wherein said coupling end comprises an integral enlarged portion of the band member received in a socket in the trigger member.

6. The dispenser of claim 5 wherein said socket is of a size larger than the integral enlarged portion at the coupling end of the band member to provide lost motion between the trigger member and the valve device.

7. The dispenser of claim 6 wherein said integral enlarged portion and said socket are cylindrical in configuration on axes extending transverse to the direction of movement of the valve device, the diameter of the cylindrical socket being larger than the diameter of the cylindrical enlarged portion.

8. The dispenser of claim 1 wherein said elongated flexible valve device comprises a band member of plastic material with the valve end being integral therewith.

9. The dispenser of claim 8 wherein said valve end comprises an integral enlarged portion of the band member engageable against a valve seat of the housing means to sandwich the nozzle of the collapsible container therebetween.

10. The dispenser of claim 9 wherein said enlarged portion has a generally flat valve surface with at least one end thereof being rounded.

11. The dispenser of claim 9 wherein the band member has a given width and a given thickness, and said enlarged portion at said valve end is wider and thicker than the remainder of the band member.

12. The dispenser of claim 1 wherein said elongated flexible valve device comprises a band member of plastic material having a generally given thickness and with a curved section conforming to a curved portion of the housing means, the curved section being thinner than said given thickness.

13. The dispenser of claim 12 wherein the housing means is elongated with a transverse end in which said opening is located, and said thinner curved section of the band member is located at a corner of the elongated housing means at the transverse end thereof.

14. The dispenser of claim 1 wherein said elongated flexible valve device comprises a band member of plastic material, and including spring means anchored between the housing means and an integral attachment means on the band member for biasing the valve device toward a closed position against the action of the trigger member.

15. A dispenser for dispensing the extrudable contents of a collapsible container fabricated of flexible film material whereby the container is collapsible in an accordion fashion, the container having a nozzle through which the contents can be discharged by collapsing the container, comprising:

including a cylinder housing means for holding the collapsible container, the housing means including an opening adjacent which the nozzle is registrable;

a piston type extruding member movable in the housing means and including a container-engaging face having a contoured structure of a predetermined configuration corresponding generally to a collapsing profile of the collapsible container, the extruding member including a flexible peripheral lip engageable with the inside of the cylinder for stripping the flexible film material of the container away from the cylinder, and the contoured structure of the container-engaging face of said extruding member including a plurality of cleats generally near the periphery of the face, inside the peripheral lip, for grippingly engaging the container during collapsing thereof; and means for moving the extruding member relative to the housing means for advancing the extruding member toward the opening in the housing means for extruding the contents of the collapsible container from the nozzle.

16. The dispenser of claim 15 wherein the contoured structure of the container-engaging face of the extruding member comprises a central portion projecting toward the opening and recess means outside the projecting portion of accommodating accordion pleats formed about the collapsible container during collapsing thereof.

17. The dispenser of claim 16 wherein said collapsible container is generally rectangular in configuration and includes hems along opposite sides thereof, and wherein said recess means include exaggerated recessed portions for accommodating the additional bulk created by collapsing of the hems of the container.

18. The dispenser of claim 15 wherein said container-engaging face comprises a unitary molded structure.

19. The dispenser of claim 15 wherein said piston type extruding member includes a trailing peripheral skirt portion behind the peripheral lip for stabilizing the extruding member during movement in the cylinder.

20. A dispenser for dispensing the extrudable contents of a collapsible container fabricated of flexible film material whereby the container is collapsible in an accordion fashion, the container having a nozzle through which the contents can be discharged by collapsing the container, comprising:

including a cylinder housing means for holding the collapsible container, the housing means including an opening adjacent which the nozzle is registrable;

a piston type extruding member movable in the housing means and having a container-engaging face, and including a plurality of cleats generally near the periphery of the face for grippingly engaging the container during collapsing thereof, the extruding member including a flexible peripheral lip engageable with the inside of the cylinder for stripping the flexible film material of the container away from the cylinder, and the container-engaging face being a molded structure and said peripheral lip and said cleats being integrally molded therewith; and means for moving the extruding member relative to the housing means for advancing the extruding member toward the opening in the housing means for extruding the contents of the collapsible container from the nozzle.

21. The dispenser of claim 20 wherein said piston type extruding member includes a trailing peripheral skirt portion behind the peripheral lip for stabilizing the extruding member during movement in the cylinder.

22. The dispenser of claim 20 wherein said container-engaging face of the extruding member includes a contoured structure comprising a central portion projecting toward the opening and recess means outside the projecting portion for accommodating accordion pleats formed about the collapsible container during collapsing thereof.

23. The dispenser of claim 22 wherein said collapsible container is generally rectangular in configuration and includes hems along opposite sides thereof, and wherein said recess means include exaggerated recessed portions for accommodating the additional bulk created by collapsing of the hems of the container.

24. In a hand dispenser for dispensing an extrudable material, the dispenser including housing means for holding the extrudable material, including a pistol grip handle and an opening in the housing means remote from the pistol grip handle through which the material is extruded, an extruding member movably mounted in the housing means for effecting extruding of the material through the opening, advancing means operatively associated with the extruding member for moving the extruding member relative to the housing means for advancing the extruding member toward the opening and, thereby, extruding the material therethrough, including a trigger member mounted adjacent the pistol grip handle for movement toward and away from the pistol grip handle to incrementally advance the extruding member for each actuation of the trigger member and, thereby, effect a metered dispensing of the extruded material, and wherein the improvement comprises a system for selectively determining a metered amount of material to be dispensed by the dispenser for each actuation of the trigger member toward the pistol grip handle, comprising:

a plurality of individual and separate, differently configured stop cams individually and interchangeably positionable between the trigger member and the pistol grip handle to limit movement of the trigger member toward the pistol grip handle and thereby determine the metered amount of material to be extruded through the opening in the housing means for each actuation of the trigger member toward the pistol grip handle, each differently configured stop cam being effective to limit movement of the trigger member a degree different from that of the other stop cams in said plurality thereof.

25. In a hand dispenser of claim 24, including means for mounting a selected one of said stop cams at a location between the trigger member and the pistol grip handle which prevents removal of the stop cam without dismantling at least one of the trigger member and pistol grip handle.

26. In a hand dispenser of claim 25, including window means in one of the trigger member and the pistol grip handle to allow visual observation of which stop cam is in position on the dispenser.

27. In a hand dispenser of claim 24, wherein the pistol grip handle is fixedly mounted to the housing means, and trigger member is pivotally mounted on the housing means adjacent the pistol grip handle, and including means for removably mounting a selected one of said stop cams on the pistol grip handle in the path of movement of the trigger member toward the pistol grip handle.

28. In a hand dispenser of claim 27, wherein said means for removably mounting the stop cam is located to prevent removal of the stop cam without disassembling the pistol grip handle.

29. A dispenser for dispensing the extrudable contents of a collapsible container fabricated of flexible film material, the container having a nozzle at a front end thereof through which the contents can be discharged by collapsing the container, and the container having a hem extending across the front end thereof, comprising a housing means for holding the collapsible container, the housing means including a front wall with an opening adjacent which the nozzle is registrable, and a slot in the front wall of the housing means for receiving the hem of the collapsible container.

30. The dispenser of claim 29 wherein said slot passes through the opening in the front wall of the housing means.

31. The dispenser of claim 29 wherein said slot has an open end for sliding the hem therethrough into the slot.

32. The dispenser of claim 31 wherein an opposite end of the slot has a reverse turned portion for accommodating one end of the hem of the container thereinto.

33. A dispenser for dispensing the extrudable contents of a container having a nozzle at a front end thereof through which the contents can be discharged, comprising:

housing means for holding the container and including a cover portion movable mounted between a closed position and an open position for loading a container into the housing means, the housing means further including a pistol grip handle and an opening in the housing means remote from the pistol grip handle through which the material is extruded;

an extruding member movably mounted in the housing means for effecting extruding of the material through the opening;

advancing means including a trigger member mounted adjacent the pistol grip handle for movement toward and away from the pistol grip handle, the trigger member being operatively associated with the extruding member to incrementally advance the extruding member for each actuation of the trigger member and, thereby, effect extruding of the material through the opening;

valve means at the opening in the housing means for opening and closing the opening; and valve latch means for holding the valve means in open condition when the cover portion of the housing means is moved to its open position.

34. The dispenser of claim 33, including means operatively associated between the valve latch means and the cover portion of the housing means for automatically closing the valve means when the cover portion is in its closed position.

35. The dispenser of claim 33 wherein said valve means comprises an elongated flexible valve device including a band member of plastic material having a valve end for opening and closing and a coupling end coupled to the trigger member, said valve latch means being operatively associated with the band member.

36. The dispenser of claim 35 wherein said valve latch means includes a detent pawl latchingly engageable with the band member when the trigger member is moved to open the valve device, the cover portion of the housing means blocking movement of the detent pawl into latching engagement with the band member when the cover is in its closed position.

37. A dispenser for dispensing an extrudable material, the dispenser including a housing means for holding the extrudable material, including a pistol grip handle and an opening in the housing means remote from the pistol grip handle through which the material is extruded, an extruding member movably mounted in the housing means for effecting extruding of the material through the opening, advancing means operatively associated with the extruding member for moving the extruding member relative to the housing means for advancing the extruding member toward the opening and, thereby, extruding the material therethrough, including a trigger member mounted adjacent the pistol grip handle for movement toward and away from the pistol grip handle to incrementally advance the extruding member for each actuation of the trigger member and, thereby, effect a metered dispensing of the extruded material, and wherein the improvement comprises valve means at the opening in the housing means operatively associated with the trigger member for opening and closing the opening for each actuation of the trigger member, and means for snapping the valve means to its closed position automatically when the trigger member reaches a predetermined point in its actuating path of travel.

38. The dispenser of claim 37 wherein said means for automatically snapping the valve means to its closed position includes a keeper member secured to the trigger member for movement therewith, the keeper member being releasably operatively engageable with the valve means, and including release means on the housing means for releasing the keeper member when the trigger member reaches the predetermined point in its actuating path of travel.

39. The dispenser of claim 38 wherein said keeper member includes a pawl projecting into an opening operatively associated with the valve means, and said release means includes a ramp for biasing the pawl of the keeper member out of said opening.

* * * * *